US007090533B1

(12) United States Patent
Houck et al.

(10) Patent No.: US 7,090,533 B1
(45) Date of Patent: Aug. 15, 2006

(54) TWIST LOCK PANEL-MOUNTED CONNECTOR

(75) Inventors: David Houck, Dearborn, MI (US); Emily Neville, Dearborn, MI (US); Joseph Mauney, South Lyon, MI (US)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/213,035

(22) Filed: Aug. 25, 2005

(51) Int. Cl.
*H01R 13/73* (2006.01)

(52) U.S. Cl. ..... 439/553; 240/559; 240/548; 240/546; 240/547

(58) Field of Classification Search ..... 439/553, 439/548, 546, 547
See application file for complete search history.

(56) References Cited

U.S. PATENT DOCUMENTS 5,338,226 A * 8/1994 Bryce et al. ..... 439/571
5,407,363 A * 4/1995 Polgar et al. ..... 439/546
5,772,469 A * 6/1998 Polgar et al. ..... 439/546
5,879,186 A * 3/1999 Harada ..... 439/549
5,888,093 A * 3/1999 Polgar et al. ..... 439/546
5,984,721 A * 11/1999 Self et al. ..... 439/546
6,450,834 B1 * 9/2002 Polgar et al. ..... 439/546
6,551,133 B1 * 4/2003 Tsukamoto et al. ..... 439/549
6,572,655 B1 * 6/2003 Johnson ..... 623/22.36
6,752,655 B1 6/2004 Kaczmarek
6,860,759 B1 * 3/2005 Nakamura et al. ..... 439/557

* cited by examiner

*Primary Examiner*—Tulsidas C. Patel
*Assistant Examiner*—Harshad C Patel
(74) *Attorney, Agent, or Firm*—Gerald E. Hespos; Anthony J. Casella

(57) ABSTRACT

A connector (10) is configured for mounting to a panel (12). The panel (12) has a mounting aperture (18) formed with a keyway (22). The connector (10) has a housing (24) with a front end (26) dimensioned to pass through the mounting aperture (18). However, keys (44, 46, 48) project out in proximity to the front end (26) of the housing (24). At least one of the keys (48) is dimensioned to pass through the keyway (22). A stop flange (50) projects out from the housing (24) rearward of the keys (44, 46, 48). A resiliently deflectable locking finger (60) projects forward of the stop flange (50) and is dimensioned to engage in the keyway (22).

12 Claims, 6 Drawing Sheets

TWIST LOCK PANEL-MOUNTED CONNECTOR

BACKGROUND OF THE INVENTION

1. Field of the Invention

The invention relates to a panel mounted connector.

2. Description of the Related Art

A panel mounted connector includes a housing with opposite front and rear ends and a plurality of cavities extending between the ends. Terminal fittings are connected to ends of wires and are mounted in the respective cavities in a rear-to-front direction so that the wires extend from the rear end of the housing. Locks are formed in the cavities and/or on the terminal fittings so that the terminal fittings are locked in specified positions within the respective cavities.

The housing of the panel mounted connector is configured to be mounted to a panel, such as a panel in an automotive vehicle or an apparatus. The panel has opposite front and rear surfaces, and a mounting aperture extends through the panel from the front surface to the rear surface. The mounting aperture is configured to receive the front end of the housing. However, a flange projects out from the housing at a location spaced from the front end to limit the insertion of the front end of the housing through the mounting aperture of the panel. Latches cantilever forwardly on the housing of the typical panel mounted connector. Each latch has a rearwardly facing locking surface spaced forward of the flange by a distance approximately equal to the thickness of the panel. The latches deflect as the front end of the housing is inserted into the mounting aperture of the panel. However, the latches return resiliently to engage the front surface of the panel when the flange of the housing abuts the rear surface of the panel. A panel mounted connector of this general type is shown in U.S. Pat. No. 6,860,759, which is assigned to the assignee of the subject invention.

The above-described panel mounted connectors generally perform well. However, the latch of the prior art connector often is exposed and susceptible to inadvertent contact. Such contact could disengage the connector from the panel, and could affect the performance of the circuit or the environmental sealing of the panel.

U.S. Pat. No. 5,407,363 shows a panel mounted connector without the above-described forwardly cantilevered latch. More particularly, the connector of U.S. Pat. No. 5,407,363 is used with a panel formed with a mounting aperture. Locating slots extend out from the periphery of the mounting aperture and a rotation limiting slot extends out from the mounting aperture at a location spaced rotationally from the locating slots. The connector of U.S. Pat. No. 5,407,363 has a housing with opposite front and rear ends. Locating flanges project out from the housing and can pass through the locating slots in a particular rotational orientation of the housing. Stop flanges project out on the housing at locations rotationally offset from the locating flanges and rearward of the locating flanges. The stop flanges are dimensioned limit the insertion of the housing through the mounting aperture. A limiting tab is formed on one of the locating flanges and projects rigidly back towards the rear end of the housing.

The connector of U.S. Pat. No. 5,407,363 is used by aligning the locating flanges with the locating slots and inserting the front end of the housing through the mounting aperture in the panel. The stop flanges contact the panel and limit the insertion. The housing then is rotated relative to the panel. Sufficient rotation causes the limiting tab to align with and engage in the limiting slot. U.S. Pat. No. 5,407,363 explains that the limiting tab is spaced from the stop flanges by a distance slightly less than the thickness of the panel. As a result, the inherent resiliency of the resin of the housing is intended to cause the limiting tab to snap into the limiting slot for holding the connector in a fixed rotational orientation.

The ability of the connector of U.S. Pat. No. 5,407,363 to be held securely on the panel depends on the precise dimensions of the limiting tab relative to the limiting slot and the location of the limiting tab relative to both the stop flange and the panel thickness. Dimensional variations can affect the ability of the connector to lock properly on the panel. Additionally, the connector of U.S. Pat. No. 5,407,363 requires precision in the formation of the locating slots and the limiting slot on the panel. This need for precision is complicated by the fact that the housing and the panel generally are made at different locations by different companies.

The invention was made in view of the above-described problems, and an object of the invention is to provide a connector that provides more positive locking on the panel.

Another object of the invention is to provide a connector that can be locked to the panel securely despite minor variations in the dimensions of the housing or the panel.

A further object of the invention is to provide a connector that can be mounted easily on the panel.

Still another object of the invention is to provide a panel-mounted connector that does not require a complex and precisely configured mounting aperture in the panel.

SUMMARY OF THE INVENTION

The invention relates to a connector for mounting on a panel, such as a panel of a door on an automobile. The panel has opposite front and rear surfaces and a mounting aperture extends through the panel from the front surface to the rear surface. The mounting aperture may be generally circular, but includes at lest one keyway.

The connector has a housing with opposite front an rear ends and cavities extend through the housing from the rear end to a position at or towards the front end. The connector also includes terminal fittings that are mounted to the ends of wires. The terminal fittings can be inserted into the respective cavities in a rear-to-front direction so that the wires extend rearwardly from the housing. The housing and/or the terminal fittings also may include locks for securely retaining the terminal fittings at a proper position in the respective cavities.

Portions of the housing adjacent the front end are dimensioned and configured to be inserted through the mounting aperture of the panel. In this regard, at least one key projects out near the front end of the housing and is dimensioned to enter the keyway in the mounting aperture of the panel. A stop flange projects out from the housing at a location spaced rearward from the key by a distance slightly greater than the thickness of the panel. The stop flange is dimensioned for limiting the insertion of the housing through the mounting aperture of the panel. At least one resiliently deflectable locking finger projects out on the housing at a location offset transversely from the key. At least a portion of the locking finger is closer to the front end of the housing than the stop flange, but farther from the front end of the housing than the key.

The housing is mounted to the panel by aligning the key with the keyway and inserting the front end of the housing through the mounting aperture of the panel. This is insertion will cause the leading end of the resiliently deflectable locking finger to engage the rear surface of the panel at locations adjacent the mounting aperture. As a result, the locking finger will deflect resiliently and will exert a resilient biasing force against the rear surface of the panel. The stop flange contacts the rear surface of the panel to limit the amount of insertion of the housing through the mounting aperture. At this position, the key will still be aligned with the keyway, but will be slightly forward of the front surface of the panel. The housing then is rotated relative to the panel. The key will still be forward of the panel, but will no longer align with the keyway. Therefore, the panel will be sandwiched between the key and the stop flange. Sufficient rotation of the housing will cause the locking finger to align with the keyway. As a result, the locking finger will return resiliently to an undeflected position in the keyway. The positioning of the locking finger in the keyway will prevent any further rotation of the housing relative to the panel.

The locking finger preferably is dimensioned to avoid projecting significantly forward of the panel. Thus, the locking finger is not likely to be contacted inadvertently from the front of the panel, and locked retention of the housing on the panel is more secure.

Support walls may project rearward from stop flange to the outer surface of the housing to support the stop flange. The support walls may also be near the locking finger to prevent inadvertent contact with the locking finger at locations rearward of the panel. Thus, locked retention of the housing on the panel is even more secure.

The locking finger preferably has a width that is only slightly less than the width or circumferential dimension of the keyway. Thus, the housing will not rotate significantly on the panel.

The mounting aperture in the panel does not require a separate rotation limiting slot or opening. Therefore, the shape of the mounting aperture is simple and requires less manufacturing precision than designs that require both locating slots and rotation limiting slots.

The locking finger preferably is configured to be easily resiliently deflectable about one axis, but is substantially undeflectable about other axes. The axis of deflection preferably is substantially normal to the mounting direction of the housing on the panel. Thus, the locking finger will deflect easily as the housing is being mounted on the panel. However, the locking finger will provide good resistance to rotation after the locking finger is in the key way.

DETAILED DESCRIPTION OF THE PREFERRED EMBODIMENT

Figure 1:
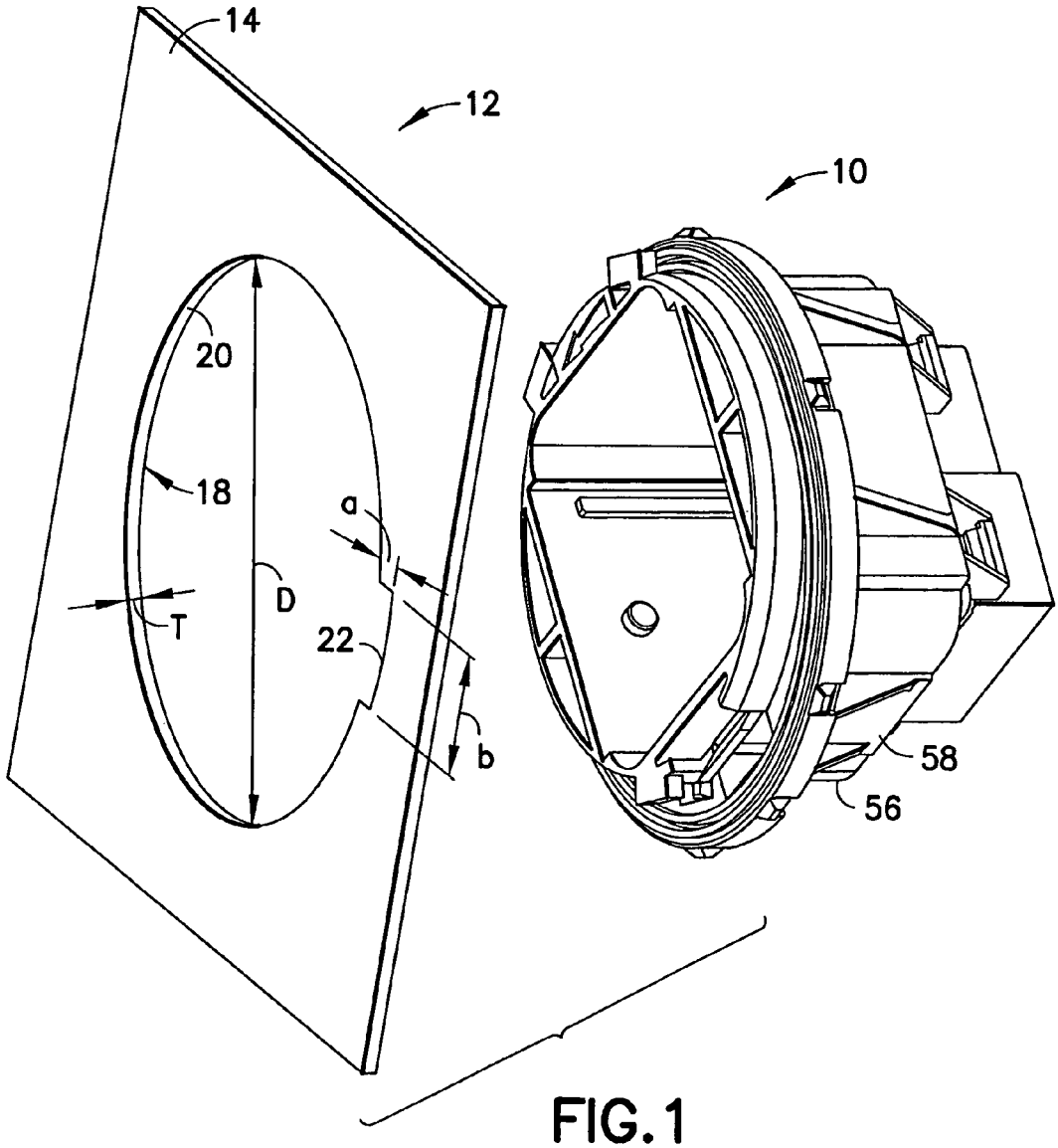
FIG. 1 is an exploded perspective view of a housing in accordance with the invention a panel to which the housing is mountable.
Figure 2:
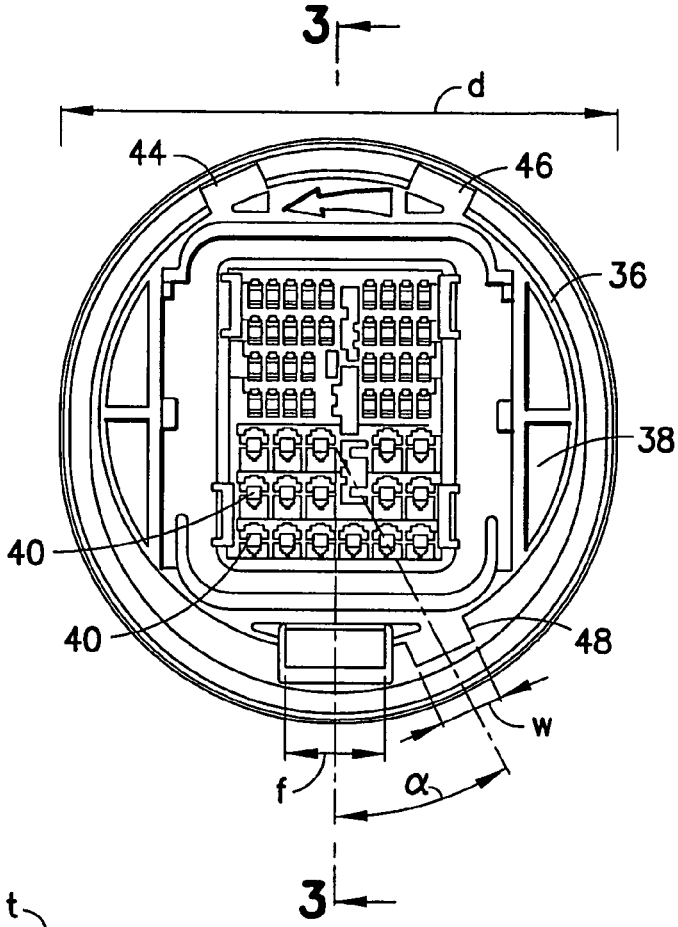
FIG. 2 is a front elevational view of the housing.
Figure 3:
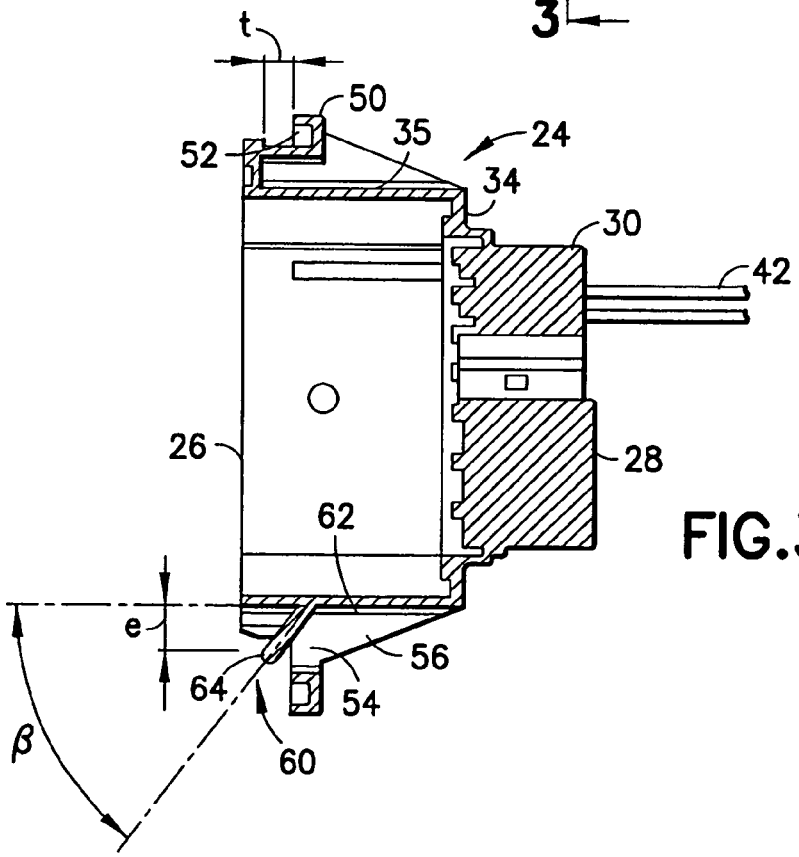
FIG. 3 is a cross-sectional view taken along line 3—3 in FIG. 2.
Figure 4:
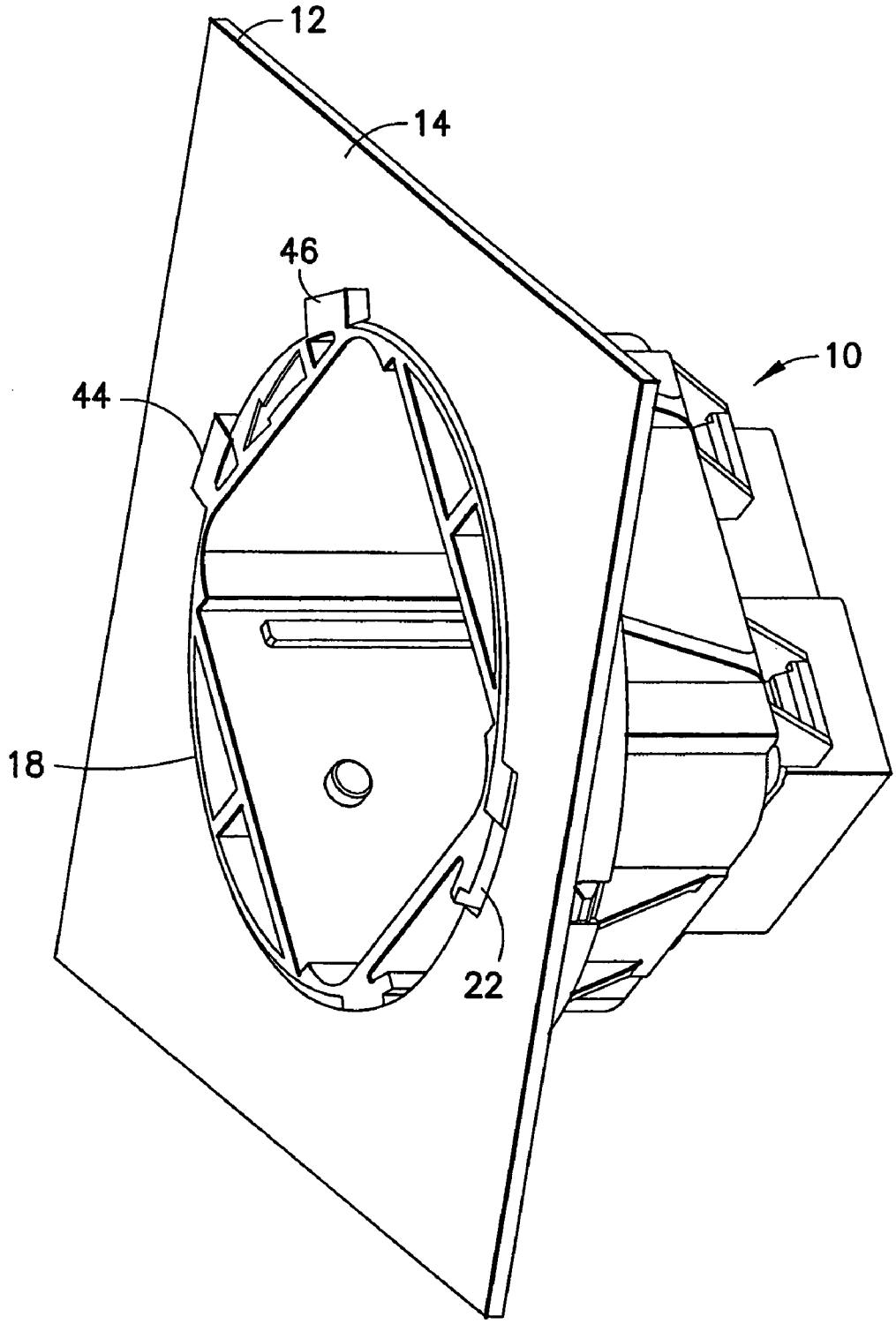
FIG. 4 is a perspective view of the housing mounted in a mounting aperture of the panel at a first rotational orientation.
Figure 5:
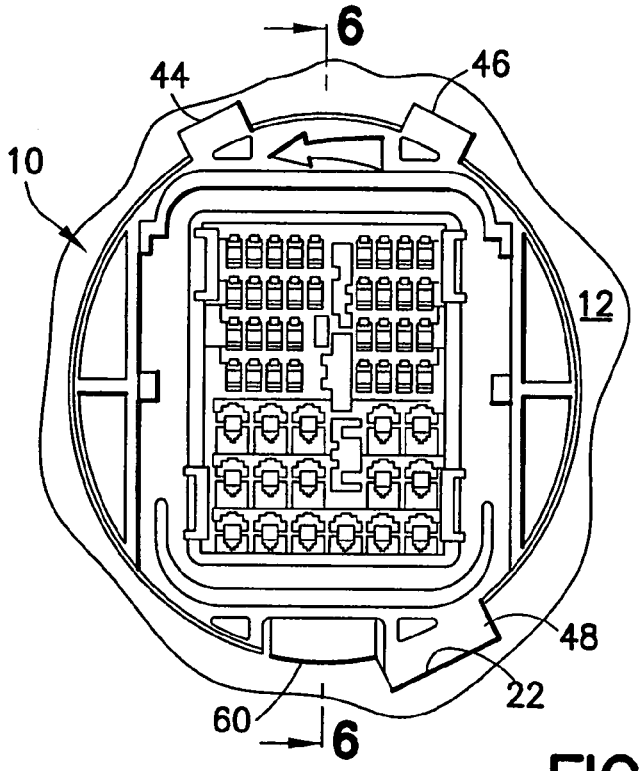
FIG. 5 is a front elevational view of the housing in mounted in the mounting aperture at the rotational orientation shown in FIG. 4.
Figure 6:
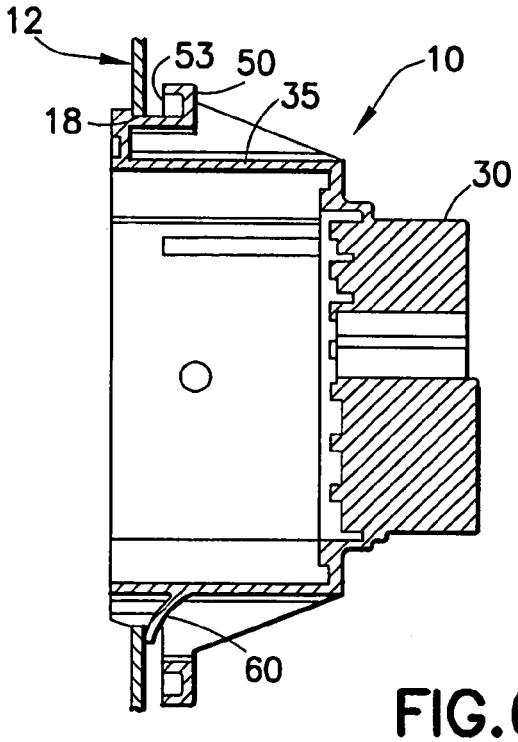
FIG. 6 is a cross-section view taken along lone 6—6 in FIG. 5.
Figure 7:
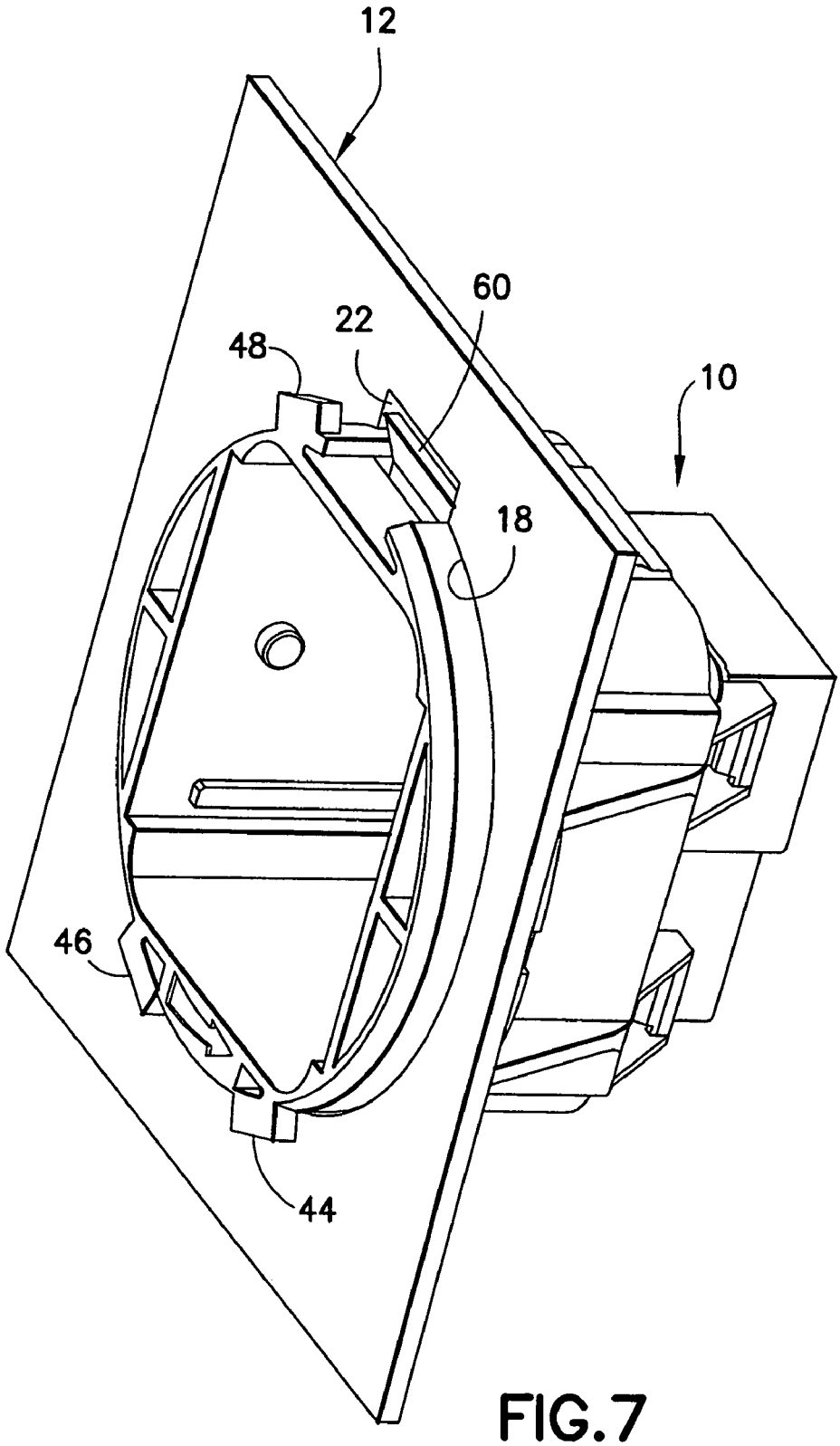
FIG. 7 is a perspective view similar to FIG. 4, but showing the housing mounted in the mounting aperture of the panel at a second rotational orientation.
Figure 8:
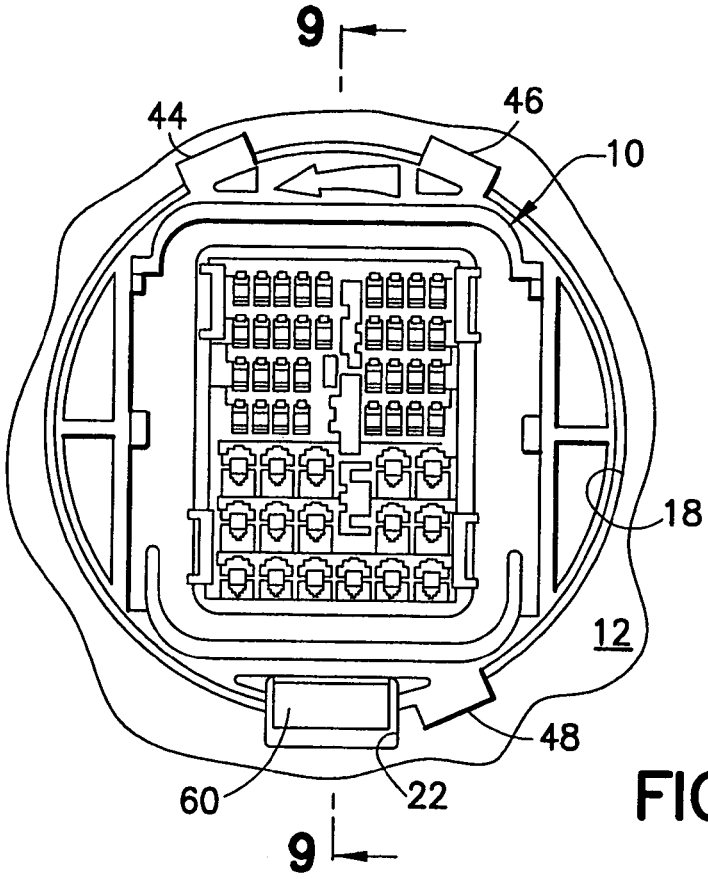
FIG. 8 is a front elevational view similar to FIG. 5, but showing the housing at the second rotational orientation.
Figure 9:
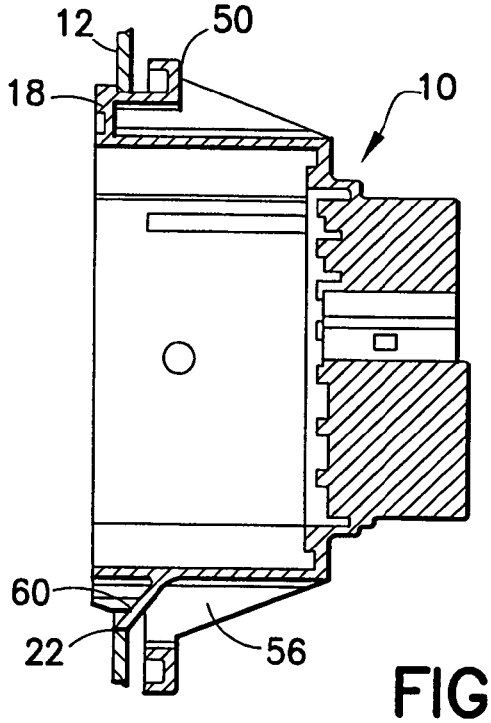
FIG. 9 is a cross-sectional view taken along line 9—9 in FIG. 8.

A connector according to the invention is identified generally by the numeral 10 in FIGS. 1 to 9. The connector 10 is mountable to a panel 12, such as the metal panel of a vehicle door. Thus, the connector 10 enables electrical connections to be made between a vehicle body and a vehicle door. The panel 12 has opposite front and rear surfaces 14 and 16 defining a thickness T. A mounting aperture 18 extends through the panel 12 from the front surface 14 to the rear surface 16. The mounting aperture 18 has a substantially circularly generated edge 20 with a diameter D, and a generally rectangular keyway 22 extends out from the circularly generated edge 20. The keyway 22 has a radial dimension "a" of about 0.25 inch and tangential or width dimension "b" of about 0.50 inch. In the illustrated embodiment, the keyway 22 extends through an arc of between about 10° and 20°.

The connector 10 has a housing 24 that is formed unitarily from a synthetic resin. The housing 24 has a front end 26 and a rear end 28. A generally block-shaped main body 30 extends forward from the rear end 28, and cavities 32 extend through the main body 30 in front-to-rear directions. A support wall 34 extends out from the front of the main body 30 and a generally rectangular tubular receptacle wall 35 extends forward from the support wall 34. A cylindrical wall 36 extends from the receptacle wall 35 to the front end 26 of the housing 24 and defines an outside diameter "d" that is slightly less than the diameter D of the circular edge 20 of the mounting aperture 18. The support wall 34 and the receptacle wall 35 and the cylindrical wall 36 define a receptacle 38 for receiving a mating connector (not shown).

The connector 10 further includes terminal fittings 40 that are mounted to ends of wires 42. The terminal fittings 40 are inserted into the cavities 32 so that the wires 42 extend from the rear end 38 of the housing 24. The terminal fittings 40 and/or the main body 30 have locks (not shown) for locking the terminal fittings in the housing 24. The configuration of the terminal fittings 40 and the locks is not central to the subject invention and is described in herein. However, those skilled in this technology will understand that locks and terminal fittings described in the prior art can be incorporated into the subject connector 10.

Keys 44, 46 and 48 project out from the cylindrical wall 36 at locations substantially adjacent the front end 26. Front surfaces of the keys 44, 46 and 48 are substantially coplanar and substantially flush with the front end 26 of the housing 24. Rear surfaces of the keys 44, 46 and 48 also are substantially coplanar. The keys 44 and 46 are spaced from one another by an arc of about 10° and 20°, and each key 44, 46 extends through a relatively small arc of about 10°. The key 48 is substantially diametrically opposite the key 44. Additionally, the key 48 defines a radial dimension "r" slightly less than the dimension "a" of the keyway 22 and a width "w" slightly less that the width "b" of the keyway 22. Thus, the key 48 is dimensioned to pass through the keyway 22. The rear surface of the key 48 closest to the key 46 is tapered forwardly.

A stop flange 50 projects out at the interface between the receptacle wall 35 and the cylindrical wall 36. The stop flange 50 is spaced rearward from the rear surfaces of the keys 44, 46 and 48 by a distance "t" that is slightly greater than the thickness T of the panel 12. The stop flange 50 defines a diameter FD that exceeds the diameter D of the mounting aperture 14. A continuous groove 52 extends into the front face of the stop flange 50 for receiving a resilient seal 53 that will seal against the rear surface 16 of the panel 12. An opening 54 extends through the flange 50 at a location radially inwardly from the groove 52. The opening 54 is substantially symmetrically opposite the space between the keys 44 and 46 and substantially adjacent the key 48. Two support walls 56 and 58 extend back from the rear face of the stop flange 50 to the receptacle wall 36 on opposite sides of the opening 54. The support walls 56, 58 ensure sufficient strength for the flange 50 in the area of the opening 54.

A resiliently deflectable locking finger 60 projects forward and out at an acute angle of between about 45° and 75° from the outer surface of the receptacle wall 36. More particularly, the locking finger 60 is aligned with the opening 54 in the flange 50. Therefore, the locking finger 60 is symmetrically opposite the space between the keys 44 and 46, and is substantially adjacent the key 48. The locking finger 60 has a base end 62 that is unitary with a portion of the receptacle wall 35 substantially in the opening 54 of the stop flange 50. The locking finger 60 also has a free end 64 that projects out to a position beyond the outer surface of the receptacle wall 36 by a distance "e" that is less than the radial dimension of the keyway "a". The free end 64 of the locking finger 60 is spaced rearward of the key 48 by a distance slightly less than the thickness "t" of the panel 12 when the locking finger 60 is in an unbiased condition. The locking finger 60 also has a width "f" that is slightly less than the width "b" of the keyway 22, and preferably at least about 0.50 inch. Thus, although the locking finger 60 can deflect towards and away from the cylindrical wall 36, the locking finger 60 is substantially nondeflectable in the width direction.

The housing 24 can be mounted to the panel 12 by positioning the housing 24 rotationally so that the key 48 aligns with the keyway 22, but with the 44 and 46 closer to panel 12. Thus, the plane defined by the front surfaces of the keys 44, 46 and 48 defines an acute angle to the plane of the panel 12. The keys 44 and 46 then are advanced through the mounting aperture 18 and the circular edge 20 of the mounting aperture 18 is urged into the space between the stop flange 50 and the keys 44 and 46. The housing 24 then is rotated forwardly so that the key 48 advances through the keyway 22. As a result, the free end 64 of the locking finger 60 will be urged against the rear face 16 of the panel 12 at a position adjacent the keyway 22. Accordingly, the free end 64 of the locking finger 60 will deflect rearwardly towards the stop flange 50. The housing 24 then is rotated so that the key 48 begins leaving keyway 22 and slides onto portions of the front face 14 of the panel 12 adjacent the keyway 22. Simultaneously, the locking finger 60 slides along the rear face 16 of the panel 12 and towards the keyway 22. Sufficient rotation will cause the locking finger 60 to align with the keyway 22. As a result, the locking finger 60 will return resiliently to an undeflected position and will enter the keyway 22, thereby preventing further rotation of the housing 24.

The circular edge 20 of the mounting aperture 18 in the panel 12 is sandwiched between the stop flange 50 and the keys 44, 46 and 48 when the housing 24 is mounted properly. Additionally, the seal 53 in the groove 52 of the stop flange 50 is held in sealing engagement with the rear surface 16 of the panel 12 continuously at locations outward from the mounting aperture 18. The locking finger 60 prevents the housing 24 from rotating into a position where the housing 24 could disengage inadvertently from the panel 12. Additionally, the locking finger 60 is inward of the seal 53 in the groove 52 of the stop flange 50, and is protected further by the panel 12, the stop flange 50 and the reinforcing walls 56 and 58. Therefore, the locking finger 60 is not susceptible to inadvertent contact that could deflect the locking finger 60 into a position where the housing 24 could disengage from the panel 12.

The connector 10 might have to be separated from the panel 12 for repair or maintenance. In this situation, a screwdriver or similarly-shaped jig can be used to deflect the locking finger 60 rearwardly and towards the stop flange 50 while rotating the housing 24 into a position where the key 48 aligns with the keyway 22. The housing 24 then is tilted so that the key 48 moves rearwardly through the keyway 22 and beyond the rear face 16 of the panel 12. the housing 24 then is moved transversely so that the keys 44 and 46 are separated from the mounting aperture 18.

While the invention has been described with respect to a preferred embodiment, it is apparent that various changes can be made without departing from the scope of the invention as defined by the appended claims.

The illustrated embodiment has one locking finger and one keyway is provided in the mounting aperture. However, plural locking fingers and plural keyways can be provided.

The illustrated embodiment has three keys. However, two keys or more than three keys may be provided.

The connector can be either a male connector or a female connector.

The seal may not be required in some environments. Alternatively, additional seals or differently configured seals may be provided.

What is claimed is:

1. A connector for mounting on a panel having opposite front and rear faces and defining a thickness extending from the front face to the rear face, a mounting aperture extending through the panel from the front face to the rear face, the mounting aperture including at least one keyway, the connector comprising a housing having opposite front and rear ends, a plurality of keys projecting out from the housing in proximity to the front end of the housing, at least one of the keys being dimensioned to pass through the keyway, a stop flange projecting out from the housing at a location rearward of the keys by a distance at least equal to the thickness of the panel, at least one resiliently deflectable locking finger projecting forward from the housing and into a position forward of the stop flange and rearward of the keys by a distance less than the thickness of the panel, the locking finger being dimensioned to pass through the keyway.

2. The connector of claim 1, wherein the housing is formed unitarily from a resin.

3. The connector of claim 1, wherein the locking finger projects forward and outward on the housing at an acute angle.

4. The connector of claim 1, wherein the keys are spaced circumferentially from one another and wherein the locking finger is circumferentially substantially adjacent the first key.

5. The connector of claim 1, the stop flange extends substantially continuously around the housing and has a front surface formed with a groove facing towards the panel, a seal disposed in the groove for sealed engagement with the rear face of the panel.

6. The connector of claim 1, further comprising at least one support wall extending rearwardly from the stop flange to the housing for supporting the stop flange.

7. The connector of claim 1, wherein portions of the housing rearward of the keys and forward of the stop flange are substantially cylindrical.

8. A connector for mounting on a panel having opposite front and rear faces and defining a thickness extending from the front face to the rear face, a mounting aperture extending through the panel from the front face to the rear face, the mounting aperture including at least one keyway with a selected circumferential width dimension, the connector comprising a housing having opposite front and rear ends, a plurality of keys projecting out from the housing in proximity to the front end of the housing, at least one of the keys being dimensioned to pass through the keyway, a stop flange projecting out from the housing at a location rearward of the keys by a distance at least equal to the thickness of the panel, at least one resiliently deflectable locking finger projecting forward from the housing and into a position forward of the stop flange, the locking finger having a circumferential width dimension slightly less than the circumferential width dimension of the keyway so that the locking finger enters the keyway for preventing further relative rotation between the housing and the panel.

9. The connector of claim 8, wherein the locking finger is spaced rearward of the keys by a distance less than the thickness of the panel.

10. The connector of claim 9, wherein the locking finger projects forward and outward on the housing at an acute angle.

11. The connector of claim 10, wherein at least a first of the keys is dimensioned to pass through the keyway.

12. The connector of claim 11, wherein the locking finger is substantially adjacent the first key.

* * * * *